United States Patent [19]

Takada et al.

[11] Patent Number: 5,066,932

[45] Date of Patent: Nov. 19, 1991

[54] HELICAL FILTER

[75] Inventors: Noboru Takada; Masami Osawa, both of Tsurugashima, Japan

[73] Assignee: Toko Kabushiki Kaisha, Tokyo, Japan

[21] Appl. No.: 570,783

[22] Filed: Aug. 22, 1990

[30] Foreign Application Priority Data

Aug. 30, 1989 [JP] Japan ..... 1-223979

[51] Int. Cl.[5] ..... H01P 1/20

[52] U.S. Cl. ..... 333/202; 333/235

[58] Field of Search ..... 333/202, 219, 235, 207, 333/212, 231

[56] References Cited

U.S. PATENT DOCUMENTS

| | | | |
|---|---|---|---|
| 2,946,847 | 7/1960 | Callender | 333/207 X |
| 3,691,487 | 9/1972 | Yoshimoto | 333/202 |
| 4,061,992 | 12/1977 | Inokuchi | 333/202 |
| 4,365,221 | 12/1982 | Vizmuller | 333/219 X |
| 4,385,279 | 5/1983 | Meador | 333/202 X |

FOREIGN PATENT DOCUMENTS

| | | | |
|---|---|---|---|
| 0042901 | 3/1985 | Japan | 333/202 |

*Primary Examiner*—Eugene R. LaRoche
*Assistant Examiner*—Seung Ham
*Attorney, Agent, or Firm*—Stevens, Davis, Miller & Mosher

[57] ABSTRACT

A helical filter is provided which includes a plurality of coupled helical coils each wound around one of a plurality of substantially parallel elongated bobbins having first and second end portions. Each of the coils has an open end at a first end thereof and a grounded end at a second end thereof. A moving member for adjusting the resonance frequency of the filter is provided at the first end portion of one of the bobbins, and a bandwidth-adjusting screw is provided in the hollow interior region of one of the bobbins at the second side thereof. The screw is accessible from the second end portiion of the bobbin so as to be rotated for adjustment of the bandwidth of the filter. The bandwidth-adjusting screw is disposed at the grounded second end of the helical coil wound around the hollow bobbin.

6 Claims, 2 Drawing Sheets

HELICAL FILTER

BACKGROUND OF THE INVENTION

The present invention relates to a helical filter capable of adjusting the band width.

Generally, a helical filter comprises a plurality of helical coils which are electromagnetically coupled, each having an open end at one end thereof and a grounded end at the other. Specifically, each one of the helical coils is wound around a bobbin in a metal case, and a plurality of the cases are fixed together at their sides by soldering or welding, or the helical coil is wound around a plurality of bobbins arranged on a common base, and the entire system is covered with a case having partitions between each of the helical coils, and some others.

Then, each of the helical coils functions as a resonator, and the resonance frequency thereof is adjusted by changing the distributed capacitance between the helical coil and the case around it. The distributed capacity is changed by moving a dielectric member between the helical coil and the case or by moving in the vicinity of the coil a metal screw which is electrically connected to the case.

The resonance frequency of each resonator is made equal, and the filter is resonated against the input signal of this resonance frequency. Also, the band width of the filter is adjusted in accordance with the coupling condition between the resonators. However, once it is defined by the side of the case between the helical coils or the size of the coupling window of the partition at the time of designing, no adjustment is possible thereafter.

The same is applicable in the case where the band width is defined by the space between the helical coils without a coupling window as a matter of course.

Nevertheless, it often occurs that the band width of an assembled helical filter departs from the band width defined at the time of its design.

Hence, if the band width is rigidly regulated, the yield of the helical filter is significantly reduced.

SUMMARY OF THE INVENTION

It is an object of the present invention to provide a helical filter capable of adjusting the band width with ease even after it is assembled.

It is yet another object of the present invention to provide a helical filter capable of adjusting the resonance frequency and the band width independently.

A helical filter according to the present invention comprises a plurality of coupled helical coils, each having an open end at one end thereof and a grounded end at the other, and is characterized in that, in the interior of at least one bobbin with a helical coil wound around it, a screw which can be rotated from one side of the bobbin is screwed in for adjusting the band width.

BRIEF DESCRIPTION OF THE DRAWINGS

The above mentioned characteristics and objects of the present invention will become more apparent and the invention itself will be better understood by reference to the following description of various embodiments of the present invention, taken in conjunction with the accompanying drawings, wherein.

DETAILED DESCRIPTION OF THE PREFERRED EMBODIMENTS

Figure 1:
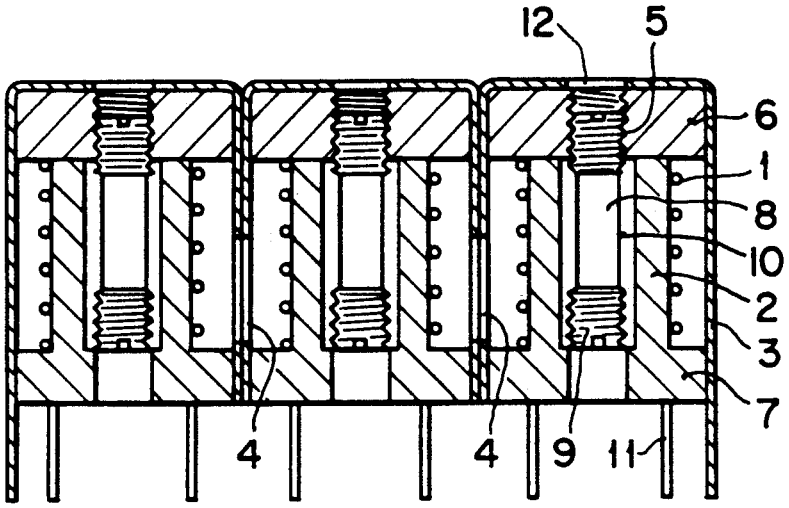
FIG. 1 is a longitudinal sectional view representing an embodiment of a helical filter according to the present invention.

A helical filter shown in FIG. 1 has three helical coils 1, each being wound around each one of different bobbins 2 and covered by a case 3. Although the cases 3 are fixed with each other by their sides, they are provided with coupling windows 4 on the sides between the coils 1. The coil 1 has its open end at the upper side of the bobbin 2 while its grounded end at the lower side is connected to the terminal 11 of a base 7. For the helical coils 1 on the input and output sides on the left and right hands, taps (not shown) are provided and connected respectively to the input and output terminals 11.

A metal screw 5 is provided for adjusting the resonance frequency and is screwed in a nut 6 provided at the upper side of the bobbin 2. The nut 6 is connected to the case 3 which is grounded, and the screw 5 can be moved vertically from the upper side of the bobbin 2 to its interior. 12 is a hole on the upper side of the case 3. Through this hole 12, the screw 5 is driven by a screw driver.

The bobbin 2 and the base 7 located at the bottom of the bobbin 2 are integrally formed with synthetic resin, and a through hole 8 is provided in the center of the bobbin 2, which extends therethrough to the base 7.

At the lower end of the through hole 8 inside the bobbin 2, a screw 9, which can be rotated to move vertically from the base side at its lower end, is screwed in for adjusting the band width. This screw 9 is made of metal or a magnetic material such as ferrite, but unlike the screw 5, it is not grounded.

In this respect, there are provided in the through hole 8 inside bobbin 2, a plurality of fine projections 10 called ribs which extend vertically therein, and the screw 9 and screw 5 are screwed in the fine projections 10 by self-tapping. The screw 9 and screw 5 are arranged so that they are not allowed to contact each other.

Figure 2:
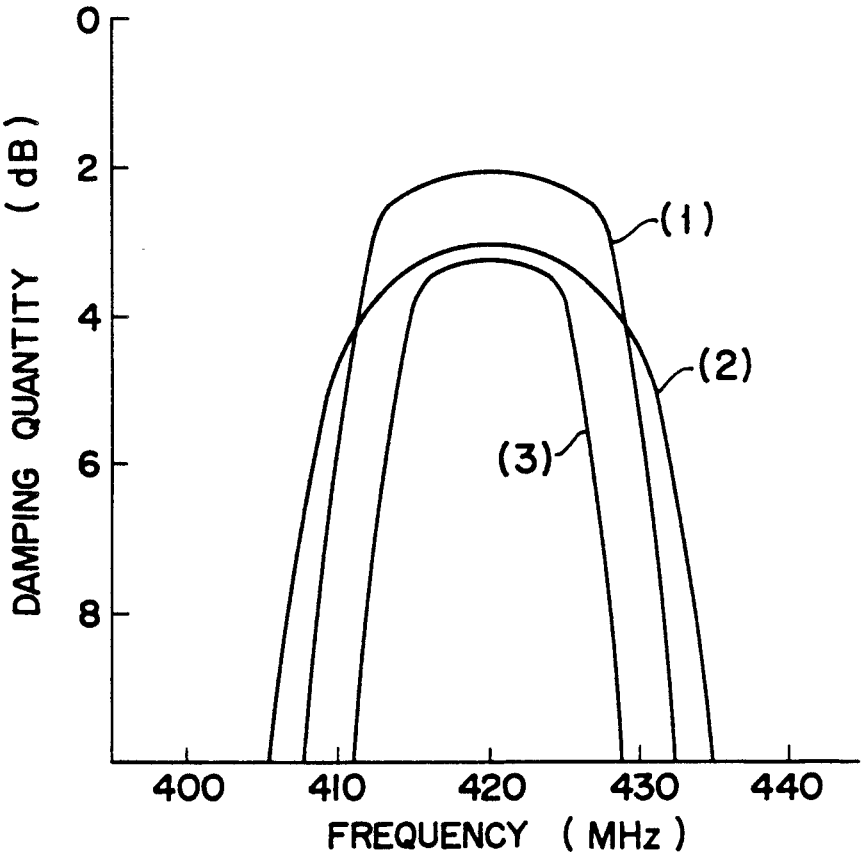
FIG. 2 is a diagram illustrating the characteristics thereof.

FIG. 2 is a diagram illustrating the characteristics of a helical filter having a structure as described above. The ordinate axis represents the damping quantities which indicate insertion losses, and the abscissa axis represents the frequencies. The resonance frequency is 420 MHz. (1) shows the characteristic for the case where the screw 9 does not exist; (2) and (3) show the characteristics in the case where the material of the screw 9 is replaced. The screw 9 is screwed in the lower end of the through hole 8 inside the bobbin 2. The characteristic (2) is in the case of using ferrite while the characteristic (3) is, brass.

The insertion loss and band width in each case are approximately as follows:

In the case of the characteristic (1) where the screw 9 does not exist, the insertion loss in the resonance frequency is 2 dB and the band width for 3 dB is 20 MHz.

In the case of the characteristic (2) where the screw 9 is made of ferrite, the insertion loss in the resonance frequency is 3 dB and the band width for 3 dB is 24 MHz.

In the case of the characteristic (3) where the screw 9 is made of brass, those obtained in the same manner are 3.2 dB and 14 MHz respectively. In this respect, aluminum also shows a characteristic close to brass.

As is readily understandable from FIG. 2, when the screw 9 exists in the bobbin 2, the insertion loss of the signal becomes greater. This means that the Q value of the helical coil 1 is slightly lowered if the screw 9 is screwed in. However, as compared with the case where the screw 9 does not exist, the insertion loss is still within 2 dB. Hence, no inexpedience is caused in practice.

When the screw 9 is conductive, the band width becomes narrower. If it is formed of a ferrite insulator, the band width becomes wider.

Figure 3:
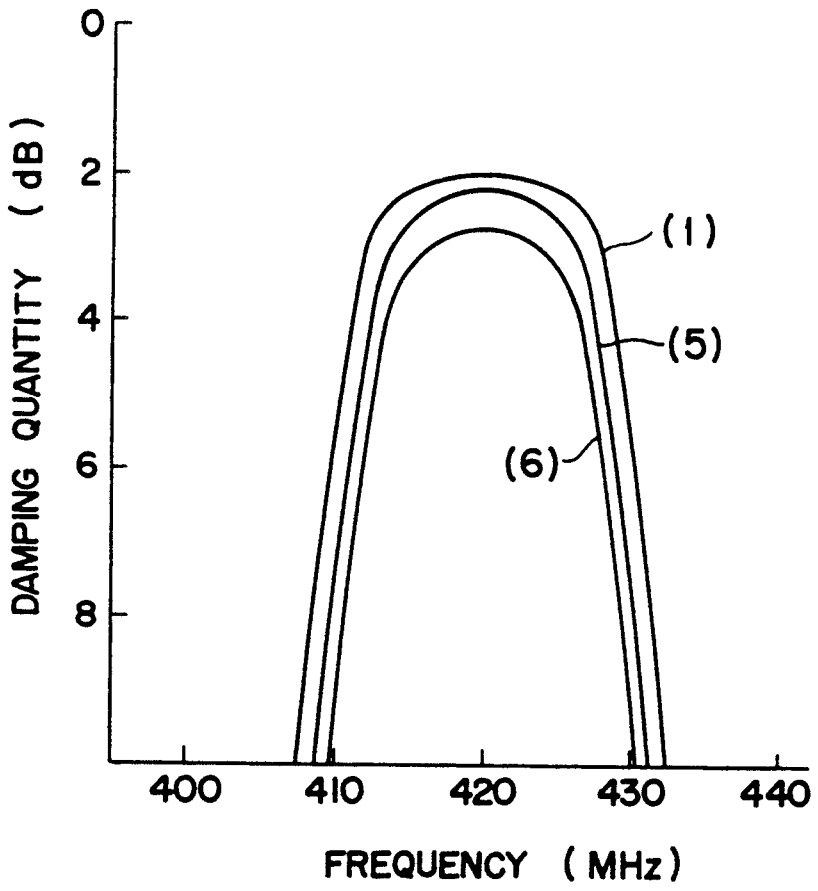
FIG. 3 is a diagram illustrating the characteristics of another embodiment of a helical filter according to the present invention.

FIG. 3 is a diagram illustrating the characteristics of another embodiment of a helical filter according to the present invention.

The characteristic diagram in FIG. 3 represents the characteristics obtainable when the screw 9 made of brass is screwed only in the bobbin 2 of the helical coil 1 located in the center of those shown in FIG. 1, and the screws 9 in the helical coils 1 on the input and output sides shown therein are removed. The resonance frequency is 420 MHz.

(5) is the characteristic in the case where the screw 9 is screwed in the lower end of the bobbin 2 as in FIG. 1. The insertion loss in the resonance frequency is 2.2 dB and the band width for 3 dB is approximately 18 MHz.

(6) is the characteristic in the case where the screw 9 is inserted further into the interior. The insertion loss and the band width are 2.7 dB and approximately 15 MHz respectively. Even if the screw 9 is moved, the resonance frequency does not change greatly unless the screw approaches the vicinity of the open end of the high-potential side of the helical coil 1. The screw 9 can be grounded, but in order to ground it, a more complex structure is required.

In this respect, for the purpose of comparison, the characteristic (1) in FIG. 2 where no screw 9 exists is shown in FIG. 3.

The band width can be adjusted with the screw 9 being screwed in the bobbin 2 of only one helical coil 1 as in this case. The insertion loss becomes less as compared with the case where the screws 9 are screwed in all the bobbins 2.

From the description set forth above, it is quite clear that the application of the present invention is not limited to the embodiments hitherto described, and that the present invention is applicable to various helical filters.

For example, according to the description of the above-discussed embodiments, the resonance frequency is adjusted by the adjusting screw 5. However, it is possible to replace this movement of the metal body with the arrangement of a dielectric moving body.

Also, the screw 9 for adjusting the band width can be made of plastic having a powdered magnetic material mixed therein.

The terminals can be those for face-to-face connections on a printed-circuit board.

Also, in the embodiments, the screw 9 is screwed in the interior of the bobbin 2. However, since the base 7 can be regarded as part of the bobbin 2, there may be a case where the screw is screwed in the portion of the base 7.

As set forth above, a helical filter according to the present invention has a screw for adjusting the band width, which is screwed in the interior of a bobbin having a helical coil wound around it, and the adjustment can be made from the base side at its lower side by rotating the screw to move vertically.

Generally, there is provided a moving body at the upper side for adjusting the resonance frequency, and since the screw for adjusting the band width is arranged at the lower side where the helical coil is grounded, the resonance frequency and the band width can be adjusted independently from the upper and lower sides respectively.

As a result, even if the band width departs from a designed value, the adjustment can be easily made so as to prevent the yield from being lowered even against a rigid standard of band width; hence, the invention has extremely practicable applications.

What is claimed is:

1. A helical filter, comprising:

a plurality of elongated bobbins oriented substantially parallel to one another and each having respective first and second end portions, at least one of said bobbins having a hollow interior region;

a plurality of coupled helical coils, each of said coils being wound on one of said bobbins respectively, each of said coils having an open end at a first end thereof and a grounded end at a second end thereof;

a member for adjusting the resonance frequency of said filter, said member being provided at the first end portion of at least one of said bobbins so as to be adjustably movable relative to said one of said bobbins to adjust said resonance frequency; and a screw provided in said hollow interior region of said at least on of said bobbins, said screw being accessible from the second end portion of said at least one of said bobbins having said hollow interior region to be rotatable to adjust the bandwidth of said filter.

2. A helical filter according to claim 1, wherein the screw for adjusting the bandwidth is made of a magnetic material.

3. A helical filter according to claim 1, wherein the screw for adjusting the bandwidth is made of a metallic material.

4. A helical filter, comprising:

a plurality of elongated bobbins oriented substantially parallel to one another and each having respective first and second end portions, at least one of said bobbins having a hollow interior region;

a plurality of coupled helical coils, each of said coils being wound on one of said bobbins respectively, each of said coils having an open end at a first end thereof and a grounded end at a second end thereof;

a member for adjusting the resonance frequency of the filter, said member being supported at the first end of one of the helical coils so as to be movable relative thereto;

a screw provide din said hollow interior region of said at least one of said bobbins, said screw being disposed at the grounded end of said one of said coils and being accessible from the grounded end of said one of said coils to be screwed to adjust the bandwidth of said filter.

5. A helical filter according to claim 4, wherein the screw for adjusting the bandwidth is made of a magnetic material.

6. A helical filter according to claim 4, wherein the screw for adjusting the bandwidth is made of a metallic material.

* * * * *